US008485709B2

(12) United States Patent
Wan et al.

(10) Patent No.: US 8,485,709 B2
(45) Date of Patent: Jul. 16, 2013

(54) LIGHT EMITTING DIODE DISPLAY MODULE SET AND WASHING DEVICE COMPRISING THE SAME

(75) Inventors: Xiu Wan, Nanjing (CN); Shurong Zhang, Nanjing (CN)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 665 days.

(21) Appl. No.: 12/681,628

(22) PCT Filed: Nov. 25, 2008

(86) PCT No.: PCT/EP2008/066130

§ 371 (c)(1),
(2), (4) Date: Apr. 5, 2010

(87) PCT Pub. No.: WO2009/068518

PCT Pub. Date: Jun. 4, 2009

(65) Prior Publication Data

US 2010/0218565 A1 Sep. 2, 2010

(30) Foreign Application Priority Data

Nov. 29, 2007 (CN) ..... 2007 2 0041728 U

(51) Int. Cl.
*F21V 7/04* (2006.01)

(52) U.S. Cl.
USPC ..... 362/555; 362/23.01; 362/23.09; 362/23.11; 362/23.12

(58) Field of Classification Search
USPC ..... 362/23, 28–30, 97.1, 97.3, 555, 23.01, 362/23.09, 23.11, 23.12; 200/313–314, 317
See application file for complete search history.

(56) References Cited

U.S. PATENT DOCUMENTS

| | | | | |
|---|---|---|---|---|
| 4,012,632 | A * | 3/1977 | Stone | 362/23 |
| 5,504,661 | A * | 4/1996 | Szpak | 362/30 |
| 7,441,913 | B2 * | 10/2008 | Bayersdorfer | 362/29 |
| 7,517,103 | B2 * | 4/2009 | Furuya et al. | 362/30 |
| 2005/0002170 | A1 * | 1/2005 | Jacobs et al. | 362/23 |
| 2009/0303695 | A1 | 12/2009 | Buchstab et al. | |

FOREIGN PATENT DOCUMENTS

| | | | |
|---|---|---|---|
| DE | 202007004860 | U1 | 8/2007 |
| JP | 2001-332771 | A | 11/2001 |

* cited by examiner

*Primary Examiner* — Robert May
(74) *Attorney, Agent, or Firm* — James E. Howard; Andre Pallapies

(57) ABSTRACT

A light emitting diode display module includes a circuit board with a plurality of light emitting diodes, a bracket with a plurality of grids, and a light conductive panel that includes a plurality of light conductive portions in the grids and in a one-to-one correspondence with the plurality of light emitting diodes, a height of one of the light conductive portions being lower than a height of another light conductive portion, a covering film arranged on the surface of the light conductive panel, and light transmitting portions for displaying information on the covering film at positions corresponding with the plurality of light conductive portions.

15 Claims, 3 Drawing Sheets

LIGHT EMITTING DIODE DISPLAY MODULE SET AND WASHING DEVICE COMPRISING THE SAME

BACKGROUND OF THE INVENTION

The present invention relates to a display module set and a washing device comprising the display module set and, particularly, to a light emitting diode display module set and the washing device using the module set.

Light emitting diode display module sets are widely applied in various washing devices (such as, washing machines, dishwashers and so on) to display a current operation status of a respective washing device so as to facilitate users' operations.

The structure of a currently available light emitting diode display module set is shown in FIG. 1, in which the display module set is covered with a layer of a thin film; on the thin film are provided letters or patterns for displaying different information. The portions corresponding to the letters or patterns are of a transparent design and the rest portions are of an opaque design. Beneath the thin film a light conductive panel is provided. The thin film and the light conductive panel are bonded together by way of adhesion. The whole light conductive panel is made of a transparent material, whereon a plurality of light conductive columns are arranged corresponding to the information to be displayed. All the light conductive columns are substantially of the same height. On both sides of the light conductive panel clamping means are arranged respectively; beneath the light conductive panel is arranged a bracket, and the bracket is made of an opaque material; the clamping means on both sides of the light conductive panel are directly clamped at the two sides of the bracket. On the bracket are arranged a plurality of grids corresponding to said plurality of light conductive columns, so as to block the light rays passing through adjacent light conductive columns. During assembly said light conductive columns are housed correspondingly in said grids. A piece of printed circuit board is beneath the bracket, on which circuit board are laid out light emitting diodes corresponding to the information to be displayed and other electronic elements and circuits. In addition, grooves are provided, so as to form the complete display module set by cooperating with the clamping means on the bracket.

The light emitting diode display module set is mounted on the control panel of a washing device, and at the same time, power switch buttons and a program knob for selecting different washing programs are also provided on the control panel.

In the case of a washing machine to be set in operation, a user places clothes to be washed into the washing machine, selects a corresponding washing program by rotating a program knob or by other means provided, and then switches on the power supply. Then, the power supply is connected, and the corresponding light emitting diodes in the display module set are lit up, light rays are displayed by passing through the light conductive columns and transmitting through the corresponding portions of the thin film, so as to display the current operating status of the washing machine to the user. In the case of a dishwasher, the same sequence of operations may occur after a user has placed crockery and the like to be cleaned into the dishwasher.

However, there is a problem in such a display module set, that is, corresponding to the displayed information, a complete display of different information needs different numbers of light emitting diodes, for example, time information is usually of a seven-segment numeric type, so one digit of a number normally needs seven light emitting diodes, while other information, such as temperature or rotating speed, needs only one light emitting diode for its implementation, therefore, the light emitting diodes for displaying time information are arranged relatively compactly, while the light emitting diodes for displaying other information are arranged relatively loosely; since all light conductive columns are substantially identical in height, the brightness of the light emitting diode display module set may higher in the region for displaying time information than that in the region for displaying other information, causing poor readability of the displayed information.

Known solutions include: Controlling the brightness of light emitting diodes by changing the control circuit of the light emitting diodes, that is, controlling the light emitting diodes for displaying time information by one control circuit, and controlling the light emitting diodes for displaying other information by other control circuits, which will obviously make the control circuits complicated. Another solution is to control the brightness of light emitting diode display module set by changing the transparence in the transparent regions of the film covered on the outmost layer of the display module set, so as to make the brightness in the region for displaying time substantially identical with that in the region for displaying other information, but this method is difficult to implement during practical mass production and fabrication, and will lead to an increase in production costs.

BRIEF SUMMARY OF THE INVENTION

Aiming at the abovementioned problem, an object of the present invention is to provide a display module set with simple structure and being capable of controlling its brightness substantially consistently to ensure the readability of the displayed information.

The abovementioned object of the present invention is achieved in the following manner: A light emitting diode display module set, comprising: a circuit board provided with a plurality of light emitting diodes, a bracket provided with a plurality of grids, a light conductive panel provided with a plurality of light conductive portions and a covering film arranged on the surface of said light conductive panel, wherein said light conductive portions are housed in said grids and in one-to-one correspondence with said plurality of light emitting diodes, light transmitting portions for displaying different information are arranged on said covering film at the positions corresponding to said light conductive portions, the height of at least one of the light conductive portions being lower than the heights of the other light conductive portions.

By changing the heights of the light conductive portions, the brightness displayed by the light emitting diodes through the covering film can be controlled, so as to ensure the brightness of the information displayed by the display module set to be substantially consistent, in particular, substantially even or uniform across the whole of the light conductive panel.

As one preferred embodiment of the present invention, the height of said at least one of the light conductive portions is ½ to ⅔ of the heights of the other light conductive portions.

Another object of the present invention is to provide a washing device comprising the abovementioned light emitting diode display module set.

This object of the present invention is achieved as follows: a washing device comprising the abovementioned light emitting diode display module set, wherein the information displayed through said light-transmitting portions by the light emitting diodes corresponding to the lower light conductive portions is time information of said washing device, and the information displayed through said light-transmitting portions by the light emitting diodes corresponding to the higher light conductive portions is other information.

Thus, by changing the heights of the light conductive portions it can control the display brightness of the region displaying the time information and the other information, so as to make the display brightness of time information and the other information substantially consistent and to ensure the readability of the information.

As a preferred embodiment of the present invention, the light emitting diodes corresponding to said lower light conductive portions form a seven-segment numeric arrangement to display the time information such as the time needed for completing a program, or the remaining time from the completion of the program, etc.

Preferably, the information displayed through said light-transmitting portions by the light emitting diodes corresponding to the higher light conductive portions includes information indicating temperature, rotating speed and operation status, so as to display the current water temperature, rotating speed, current washing program as well as other auxiliary information to users to facilitate their operation.

BRIEF DESCRIPTION OF DRAWINGS

Exemplary embodiments of the present invention are now described with reference to the accompanying drawing. In the drawing.

DETAILED DESCRIPTION OF EXEMPLARY EMBODIMENTS OF THE PRESENT INVENTION

Figure 1:
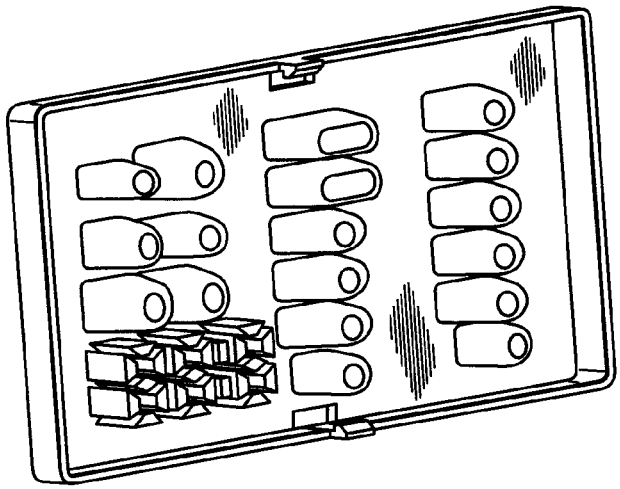
FIG. 1 is a perspective view of the light conductive panel of a prior art light emitting diode display module set.
Figure 2:
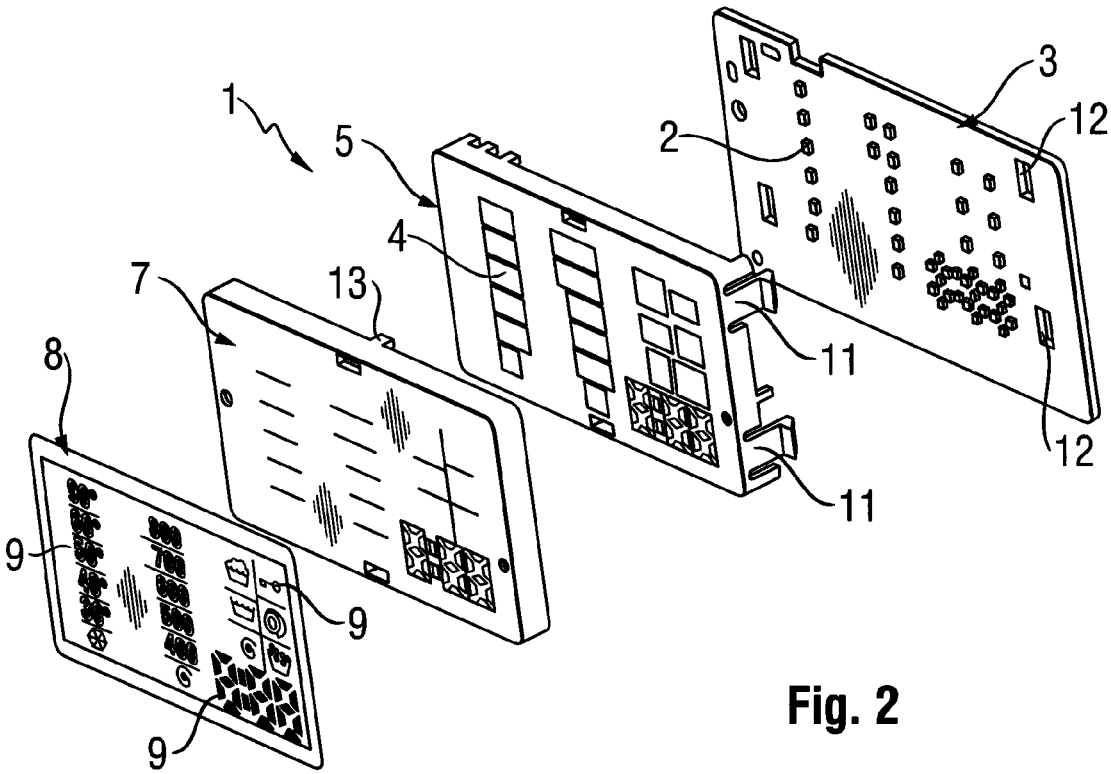
FIG. 2 is an exploded perspective view of a first embodiment of the light emitting diode display module set as first disclosed herein.
Figure 3:
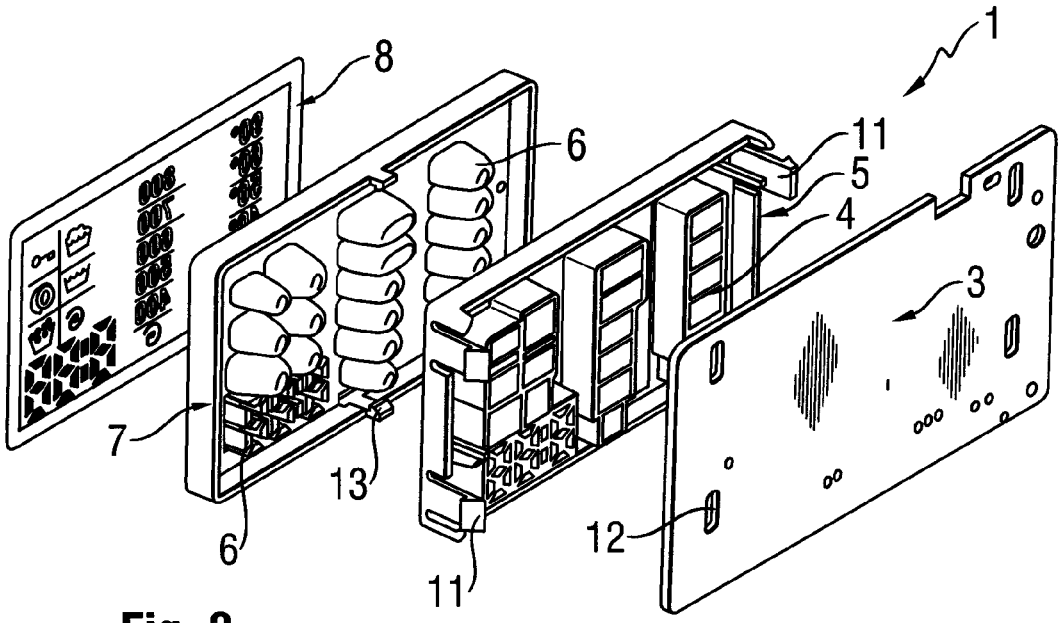
FIG. 3 is an exploded perspective view, viewing in another direction, of the light emitting diode display module set shown in FIG. 2.

Referring to FIGS. 2 and 3, a light emitting diode display module set 1 comprises a circuit board 3. On said circuit board 3 are arranged a plurality of light emitting diodes 2, other electronic elements and the circuit connecting said electronic elements and light emitting diodes. Light emitting diodes 2 comprised by said plurality are distributed according to the position of information to be displayed. The light emitting diodes 2 are as well distributed according to different information to be provided and grouped accordingly with differing numbers of light emitting diodes 2 in local groups.

A bracket 5 is arranged above said circuit board 3. On said bracket 5 are arranged, corresponding to the arrangement of said light emitting diodes 2, a plurality of grids 4 of certain heights. Two clamping means 11 are arranged to extend downwards at both sides of said bracket 5, and grooves 12 are arranged corresponding to said clamping means 11 on said circuit board 3. During their assembling, said light emitting diodes 2 are positioned approximately at the centre of the respective grids 4, and said clamping means 11 are clamped in said grooves 12, thus fixing said bracket 5 above said circuit board 3.

A light conductive panel 7 is arranged above said bracket 5. On said light conductive panel 7 are arranged, corresponding to said grids 4 or said light emitting diodes 2, a plurality of light conductive portions 6 of certain heights, a tab 13 extending downwards from either side of said light conductive panel 7. During their assembly, said light conductive portions 6 are embedded into the corresponding grids 4, and said tabs 13 are clamped at both sides of said bracket 5, thus fixing said light conductive panel 7 above said bracket 5.

Figure 4:
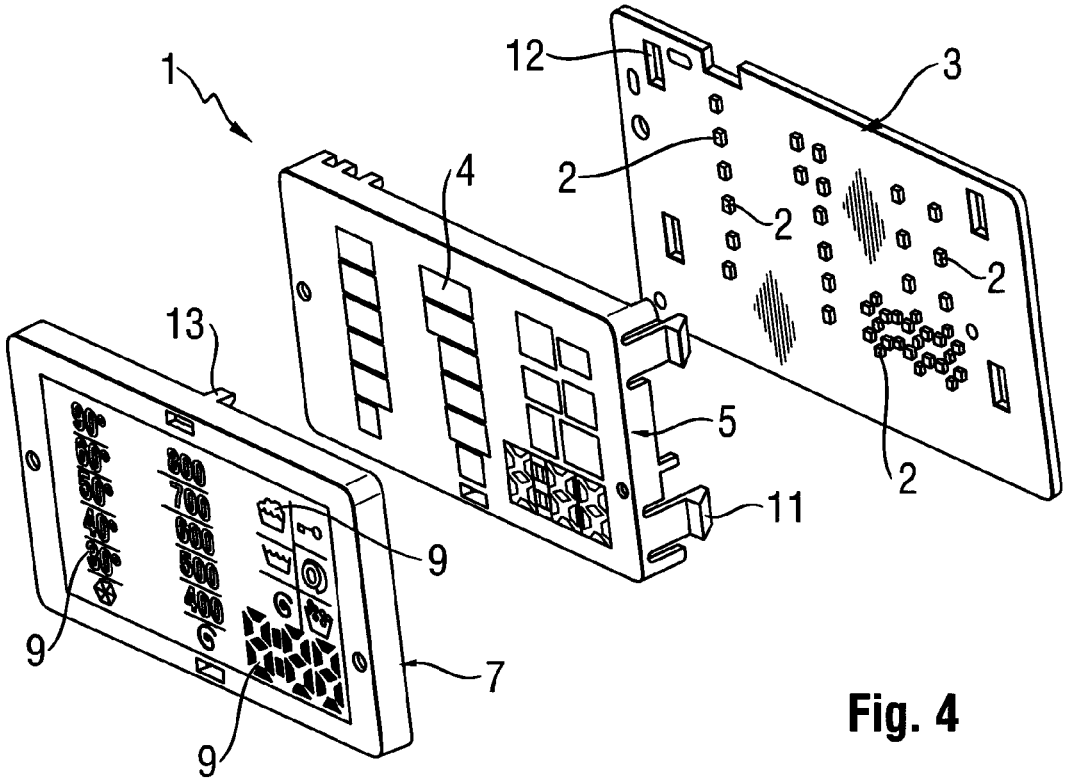
FIG. 4 is an exploded perspective view of a second embodiment of the light emitting diode display module set as first disclosed herein.

On the surface of said light conductive panel 7 is arranged a layer of covering film 8. On said covering film 8 are arranged, corresponding to information to be displayed, light-transmitting portions 9; the remaining portions are opaque portions. Said covering film 8 can be a layer of opaque plastic film bonded on the surface of said light conductive panel 7 by adhesive, and it can also be, as shown in FIG. 4, a layer of opaque lacquer sprayed onto the surface of said light conductive panel 7, which is then engraved at places corresponding to the information to be displayed, so the light can pass. Corresponding to different information to be displayed, said light conductive portions 6 are of different heights, in which for a region having a compact arrangement of light emitting diodes 2, the heights of the corresponding light conductive portions 6 are lower than that of the light conductive portions 6 corresponding to the other regions having loosely arranged light emitting diodes 2. By reducing the heights of light conductive portions 6 corresponding to the region of compact arrangement to control the displayed brightness of the corresponding light emitting diodes 2 through said covering film 8, the brightness displayed by the whole display module set 1 is thus made substantially consistent and/or uniform, so as to ensure the readability of the displayed information to any user.

Figure 5:
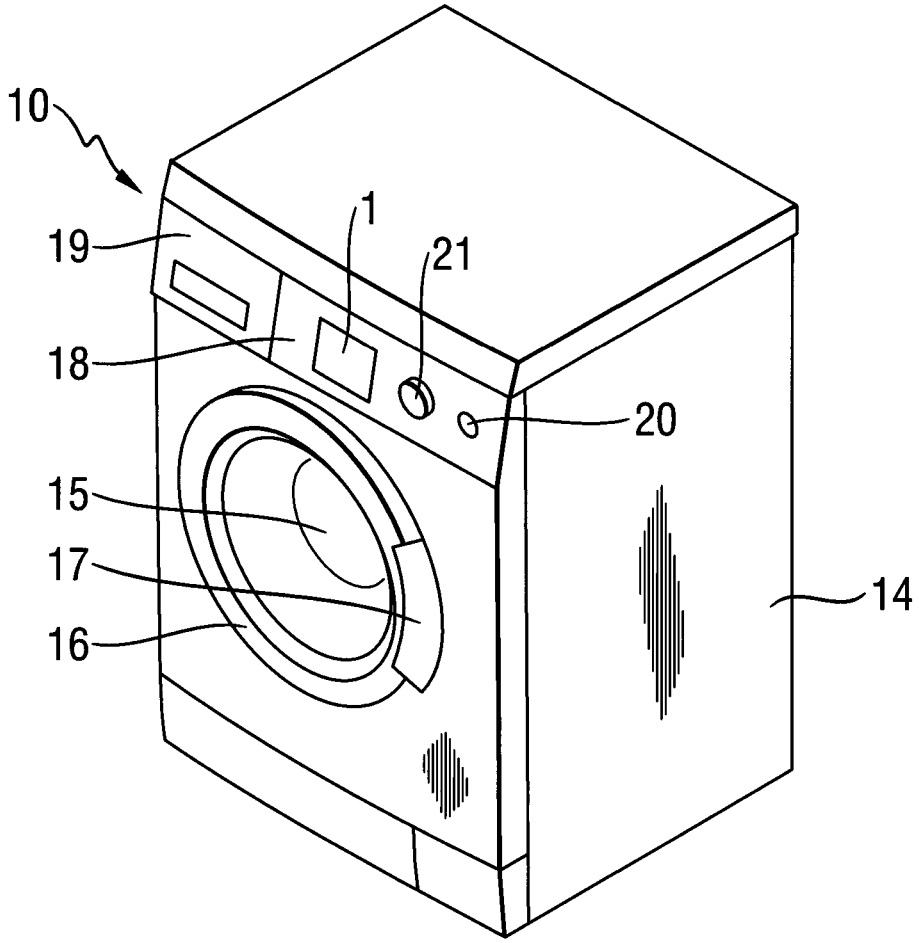
FIG. 5 is a schematic perspective view of a washing device using the light emitting diode display module set shown in FIG. 2.

Referring to FIG. 5, a washing device 10 which uses a light emitting diode display module set 1 as exemplified presently comprises a casing body 14. Inside the casing body 14 are arranged an inner drum for washing clothing by rotating around an axis, which is horizontal or is oblique in a certain angle, and an outer tub for housing said inner drum, all of these not shown in the figure for the sake of simplicity. There is an opening for inserting clothing 15 arranged at an appropriate position in the front of said casing body 14 for a user to introduce or take out clothing, and a glass door assembly 16 corresponding to said opening for inserting clothing 15 is arranged on said casing body 14, connected by a hinge arrangement. A user can observe the washing status of clothing inside through said glass door assembly 16, and at the same time, can open or close it by a door handle 17 arranged on said glass door assembly 16. Above said glass door assembly 16 are arranged a control panel 18 and a detergent distributing box 19, on said control panel 18 are arranged a power switch 20 for the user to operate the device, a program-selecting knob 21 and said light emitting diode display module set 1. Corresponding to different washing programs of said washing device, the information displayed by the light emitting diodes 2 corresponding to relatively high light conductive portions 6 of said display module set 1 are numeric information and other symbol information, that is, the information comprising, displayed in a numeric form, current temperature information of the washing device 10 and the rotating speed information of the inner drum, and, represented in symbol forms, the information such as "rinsing", "child lock", "excessive foam", etc. The information displayed by the light emitting diodes 2 corresponding to relatively low light conductive portions 6 is time information, that is, the time that the washing program ends or the remaining time before the program will end.

When said washing device 10 is used by a user to wash clothing, firstly said glass door assembly 16 is opened, then the clothing to be washed is introduced into the inner drum inside said casing body 14, said glass door assembly 16 is closed and a proper quantity of detergent is added into the detergent distributing box 19. Then an intended washing program of the washing device 10 is selected via said program selecting knob 21, and the power switch 20 is turned on. At this time, the circuit in the circuit board is connected, and corresponding light emitting diodes 2 are lit up, light-rays are displayed through the light-transmitting portions 9 of said covering film 8 to show corresponding information to the user. The arrangement of light emitting diodes 2 in the region displaying time information is relatively compact, while in the region displaying other information the arrangement of the light emitting diodes 2 is relatively loose. Therefore, the height of light conductive portions 6 corresponding to this region is reduced so that the distance between said light emitting diodes 2 and their corresponding light conductive portions 6 is larger than the distance between the light emitting diodes 2 in other regions and their corresponding light conductive portions 6; and the height of the light conductive portions 6 corresponding to the region displaying time information is reduced to ½ to ⅔ of the heights of the light conductive portions 6 corresponding to the region displaying other information. Thereby the brightness of information displayed by the light emitting diodes 2 through the covering film 8 is made substantially consistent and uniform, so as to ensure the easy readability of the displayed information, and to facilitate the operation by the user.

Obviously, the above-described light emitting diode display module set 1 can not only be used in a washing device for clothing, such as a washing machine, a dryer, a washing and drying machine, etc., but also in other washing devices that need to display information to users, such as a dishwasher, etc., and of course it can also be used in other household electric appliances, which can be readily accomplished without any need for inventive modification, and a washing device is merely taken as an example for the sake of illustration herein.

In summary, within the scope of the basic technical idea of the present invention, any variation carried out by a person skilled in the relevant art as disclosed herein or otherwise apparent is within the protective scope of the invention.

The invention claimed is:

1. A light emitting diode display module, comprising:
a circuit board with a plurality of light emitting diodes;
a bracket with a plurality of grids; and
a light conductive panel comprising:
a plurality of light conductive portions in the grids and in a one-to-one correspondence with the plurality of light emitting diodes, a height of one of the light conductive portions being lower than a height of another light conductive portion;
a covering film arranged on the surface of said light conductive panel; and
light transmitting portions for displaying information on the covering film at positions corresponding with the plurality of light conductive portions.

2. The light emitting diode display module of claim 1, wherein the height of the light conductive portion is ½ to ⅔ of the height of the another light conductive portion.

3. A washing machine comprising:
a light emitting diode display module configured to display time information and other information of the washing machine, said light emitting diode display module having:
a circuit board with a plurality of light emitting diodes;
a bracket with a plurality of grids;
a light conductive panel comprising:
a plurality of light conductive portions in the grids and in a one-to-one correspondence with the plurality of light emitting diodes, a height of one of the light conductive portions being lower than a height of another light conductive portion;
a covering film arranged on the surface of said light conductive panel; and
light transmitting portions for displaying information on the covering film at positions corresponding with the plurality of light conductive portions, wherein the information corresponding to the another light conductive portion comprises the time information of the washing machine, and the information corresponding to the one of the light conductive portions is the other information.

4. The washing machine of claim 3, wherein the light emitting diodes corresponding to lower light conductive portions of the light conductive portions forms a seven-segment numeric type.

5. The washing machine of claim 3, wherein the information displayed through said light-transmitting portions by the light emitting diodes corresponding to higher light conductive portions of the light conductive portions includes information indicating temperature, rotating speed, and operation status.

6. A light emitting diode display module, comprising:
a circuit board having grooves;
a first plurality of light emitting diodes provided at a first region of the circuit board;
a second plurality of light emitting diodes provided at a second region of the circuit board;
a light conductive panel having a light conductive panel body with a plurality of light conductive portions projecting from a first surface thereof in a one-to-one correspondence with and conducting light from said first plurality of light emitting diodes and said second plurality light emitting diodes; and
a covering film having light-transmitting portions in correspondence with said plurality of light conductive portions and which transmit light from said first plurality of light emitting diodes and said second plurality light emitting diodes,
wherein said light conductive portions corresponding to said first plurality of light emitting diodes have a height which is lower than that of the light conductive portions corresponding to the second plurality light emitting diodes.

7. The light emitting diode display module of claim 6, wherein said light conductive portions corresponding to said first plurality of light emitting diodes display information indicating time.

8. The light emitting diode display module of claim 7, wherein said light conductive portions corresponding to said second plurality of light emitting diodes display information other than time information.

9. The light emitting diode display module of claim 6, further comprising a bracket having:
a plurality of grids corresponding to said first plurality of light emitting diodes and said second plurality light emitting diodes; and clamping means which correspond to and are received by said grooves to fix said bracket above said circuit board.

10. The light emitting diode display module of claim 9, wherein said clamping means are clamped in said grooves such that said light emitting diodes are positioned approximately at the centre of the respective grids.

11. The light emitting diode display module of claim 9, wherein said light conductive panel has tabs which clamp at sides of said bracket to fix said light conductive panel above said bracket such that said light conductive portions are embedded into the corresponding grids.

12. The light emitting diode display module of claim 6, wherein the light emitting diode display module is for a washing machine.

13. A washing device, comprising:

a control panel having a light emitting diode display module configured to display information, the light emitting diode display module including:

a first plurality of light emitting diodes provided at a first region of the light emitting diode display module;

a second plurality of light emitting diodes provided at a second region of the light emitting diode display module;

a bracket with a plurality of grids corresponding to said first plurality of light emitting diodes and said second plurality of light emitting diodes;

a light conductive panel having a light conductive panel body with a plurality of light conductive portions projecting from a rear surface thereof so as to be embedded in the grids in a one-to-one correspondence with the first plurality of light emitting diodes and the second plurality of light emitting diodes, wherein a height of the light conductive portions in one-to-one correspondence with the first plurality of light emitting diodes is lower than a height of the light conductive portions in one-to-one correspondence with the second plurality of light emitting diodes;

a covering film arranged on a front surface of said light conductive panel; and light transmitting portions for displaying information on the covering film at positions corresponding with the plurality of light conductive portions.

14. The washing device of claim 13, wherein said light conductive portions corresponding to said first plurality of light emitting diodes display information indicating time.

15. The washing device of claim 14, wherein said light conductive portions corresponding to said second plurality of light emitting diodes display information indicating temperature, rotating speed and operation status.

* * * * *